US008246153B2

(12) United States Patent
Miyajima

(10) Patent No.: US 8,246,153 B2
(45) Date of Patent: Aug. 21, 2012

(54) BUBBLE CONTROL UNIT, LIQUID EJECTING HEAD, AND LIQUID EJECTING APPARATUS

(75) Inventor: Hiroki Miyajima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 349 days.

(21) Appl. No.: 12/548,388

(22) Filed: Aug. 26, 2009

(65) Prior Publication Data

US 2010/0053284 A1 Mar. 4, 2010

(30) Foreign Application Priority Data

Aug. 27, 2008 (JP) ..... 2008-218072

(51) Int. Cl.
*B41J 2/19* (2006.01)

(52) U.S. Cl. ..... 347/92; 347/93; 347/85; 347/84

(58) Field of Classification Search ..... 347/92, 347/93, 2, 93.84, 859
See application file for complete search history.

(56) References Cited

U.S. PATENT DOCUMENTS

| | | | | |
|---|---|---|---|---|
| 4,673,955 | A * | 6/1987 | Ameyama et al. | 347/86 |
| 5,030,973 | A * | 7/1991 | Nonoyama et al. | 347/93 |
| 5,489,932 | A * | 2/1996 | Ceschin et al. | 347/87 |
| 5,841,455 | A * | 11/1998 | Tanaka et al. | 347/87 |
| 5,936,650 | A * | 8/1999 | Ouchida et al. | 347/89 |
| 6,120,140 | A * | 9/2000 | Hirosawa et al. | 347/93 |
| 6,394,590 | B1 * | 5/2002 | Koitabashi et al. | 347/86 |
| 6,474,797 | B2 * | 11/2002 | Kurata et al. | 347/85 |
| 6,840,610 | B2 * | 1/2005 | Taniguchi et al. | 347/86 |
| 6,932,462 | B2 * | 8/2005 | Watanabe | 347/65 |
| 7,063,414 | B2 * | 6/2006 | Harakawa | 347/93 |
| 7,252,378 | B2 * | 8/2007 | Lee | 347/87 |
| 7,318,639 | B2 * | 1/2008 | Udagawa | 347/85 |
| 7,585,063 | B2 * | 9/2009 | Okuda | 347/86 |
| 7,614,733 | B2 * | 11/2009 | Haines et al. | 347/93 |
| 7,690,769 | B2 * | 4/2010 | Katayama | 347/65 |
| 7,690,777 | B2 * | 4/2010 | Wada | 347/93 |
| 8,020,982 | B2 * | 9/2011 | Mun et al. | 347/92 |
| 2002/0158950 | A1 * | 10/2002 | Altendorf | 347/92 |
| 2004/0061748 | A1 * | 4/2004 | Kuwabara et al. | 347/85 |

(Continued)

FOREIGN PATENT DOCUMENTS

JP 03182361 A * 8/1991

(Continued)

*Primary Examiner* — Matthew Luu
*Assistant Examiner* — Henok Legesse
(74) *Attorney, Agent, or Firm* — Kilpatrick Townsend & Stockton LLP

(57) ABSTRACT

Provided is a bubble control unit for a liquid ejecting head which ejects liquid from a nozzle formed on a nozzle surface. The bubble control unit includes a liquid channel through which the liquid is supplied to the nozzle. In the bubble control unit, the liquid channel includes: a first chamber; a second chamber disposed on the upstream side from the first chamber; a first communicating path which has a bubble chamber extending upward from the first chamber, and makes the liquid within the second chamber to flow into the first chamber from a first communicating path inlet of the second chamber; and a second communicating path which is provided with a second communicating path inlet below the first communicating path inlet, separately from the first communicating path inlet, and makes the liquid within the second chamber to flow into the first chamber from the second communicating path inlet.

8 Claims, 5 Drawing Sheets

U.S. PATENT DOCUMENTS

| | | | | |
|---|---|---|---|---|
| 2005/0104943 | A1* | 5/2005 | Hida | 347/93 |
| 2006/0274133 | A1* | 12/2006 | Inoue et al. | 347/93 |
| 2007/0046747 | A1* | 3/2007 | Takemoto | 347/92 |
| 2008/0151026 | A1* | 6/2008 | Kobayashi | 347/92 |

FOREIGN PATENT DOCUMENTS

| | | | |
|---|---|---|---|
| JP | 09141890 A | * | 6/1997 |
| JP | 2002-144576 | * | 5/2002 |
| JP | 2007-136687 | | 6/2007 |

* cited by examiner

BUBBLE CONTROL UNIT, LIQUID EJECTING HEAD, AND LIQUID EJECTING APPARATUS

This application claims priority to Japanese Patent Application No. 2008-218072, filed on Aug. 27, 2008, the entirety of which is hereby incorporated by reference.

BACKGROUND

1. Technical Field

The present invention relates to a bubble control unit used in a liquid ejecting head for ejecting liquid from a nozzle such as an ink jet type recording head, a liquid ejecting head, and a liquid ejecting apparatus having the same.

2. Related Art

Liquid ejecting heads that discharge (eject) droplets from nozzle s by producing pressure fluctuations in liquid within a pressure chamber include, for example, an ink jet type recording head (hereinafter, simply referred to as a recording head) used in an image recording apparatus such as an ink jet type recording apparatus (hereinafter, simply referred to as a printer), a color material ejecting head used for manufacturing of a color filter such as a liquid crystal display, an organic EL (Electro Luminescence) display, an electrode material ejecting head used for electrode formation of an FED (Surface-Emitting Display) and the like, and a bio-organism ejecting head used for manufacturing of a biochip (biotip), and the like.

For example, in the above-mentioned recording head, an ink introducing needle having an acute angled tip is inserted into an ink cartridge (hereinafter, simply referred to as a cartridge) in which ink in the form of liquid is sealed, so that ink within the cartridge is introduced into a pressure chamber of the recording head through an introducing hole set up in the tip of the ink introducing needle.

In the recording head according to the above-mentioned configuration, ideally, an ink channel extending from the ink introducing needle to the nozzle of the recording head is filled with ink. However, bubbles may intrude into the ink channel during the filling up (initial filling up) of ink within the recording head or the replacement of the ink cartridge and the like. For this reason, it is difficult to completely prevent the bubbles from being mixed in. If the bubbles intruding into the ink channel gradually grow to become larger, and a portion of the bubbles grown to an excessive size moves toward the pressure chamber due to the flow of ink, it may cause drawbacks of pressure loss due to absorption of the pressure fluctuation in operation of discharge by the bubbles, or shortage in supply of ink due to clogging of the channel by the bubbles, and the like.

In order to prevent the drawbacks caused by such bubbles, a recording head where the filter is mounted in the ink channel between the ink introducing needle and the head body has been proposed (see, for example, JP-A-2007-136687). This recording head is configured to be provided with grooves on an inner surface of the ink introducing needle, and to be capable of preventing the ink channel from being clogged up by the bubbles accumulated within the ink introducing needle.

However, in the above-mentioned recording head, since the filter is disposed parallel to the nozzle surface on which the nozzle is formed, and recent recording heads have been downsized, it has been difficult to augment the space for gathering the bubbles within the ink introducing needle, or to enlarge an area of the filter. For this reason, it has been necessary to frequently perform a cleaning operation for discharging the bubbles.

SUMMARY

An advantage of some aspects of the invention is that it provides a bubble control unit, a liquid ejecting head, and a liquid ejecting apparatus capable of suppressing the consumption of liquid by reducing the number of executions of the cleaning operation.

According to a first aspect of the invention, provided is a bubble control unit for a liquid ejecting head which ejects liquid from a nozzle formed on a nozzle surface. The bubble control unit includes a liquid channel through which the liquid is supplied to the nozzle. In the bubble control unit, the liquid channel includes: a first chamber; a second chamber disposed on the upstream side from the first chamber; a first communicating path which has a bubble chamber extending upward from the first chamber, and makes the liquid within the second chamber to flow into the first chamber from a first communicating path inlet of the second chamber; and a second communicating path which is provided with a second communicating path inlet below the first communicating path inlet, separately from the first communicating path inlet, and makes the liquid within the second chamber to flow into the first chamber from the second communicating path inlet.

The lower side of the invention (vertical lower side) is a side equivalent to the direction of gravity in a state where at least the liquid flows through the liquid channel. In addition, the upper side of the invention (vertical upper side) is a side opposed to the vertical lower side, and a side opposed to the direction of gravity in a state where at least the liquid flows through the liquid channel.

With this configuration, it is possible to accumulate the bubbles grown in the inside of the liquid channel within the bubble chamber and the second chamber to retain the bubbles, since the liquid channel through which the liquid is supplied to the nozzle is provided, and the liquid channel includes the first chamber, the second chamber disposed on the upstream side from the first chamber, the first communicating path which has the bubble chamber extending upward from the first chamber, and makes the liquid within the second chamber to flow into the first chamber from the first communicating path inlet of the second chamber, and the second communicating path which is provided with the second communicating path inlet below the first communicating path inlet, separately from the first communicating path inlet, and makes the liquid within the second chamber to flow into the first chamber from the second communicating path inlet. Herewith, it is possible to suppress the consumption of liquid by reducing the number of executions of the cleaning operation. In addition, since the two communicating paths of the first communicating path and the second communicating path independently make communication between the second chamber and the first chamber, it is possible to pass liquid in the second chamber through the second communicating path to supply the liquid to the first chamber even though the first communicating path is clogged up with the bubbles and the like. Herewith, it is possible to prevent poor discharge such as dead pixels caused by the bubbles from occurring.

In the above-mentioned configuration, it is preferable that a filter is disposed in the course of the liquid channel, and the filter is provided on the downstream side of the first chamber.

With this configuration, since the filter is disposed on the downstream side of the first chamber, it is possible to prevent the filter from being clogged up by the bubbles in the first chamber.

In the above-mentioned configuration, it is preferable that in the downstream side of the bubble chamber, a second communicating path outlet communicates with the first communicating path.

With this configuration, since the second communicating path outlet communicates with the downstream side of the bubble chamber, it is possible to prevent the second communicating path outlet from being clogged up by bubbles.

In the above-mentioned configuration, it is preferable that the second communicating path outlet of the second communicating path connected to the first chamber is provided below a first communicating path outlet connected to the first chamber.

With this configuration, it is possible to make the liquid to flow from the second communicating path directly to the first chamber separately from the first communicating path even though the accumulated bubbles have grown.

In the above-mentioned configuration, it is preferable that a secondary bubble chamber is provided on the upper portion of the second chamber by forming the upper surface of the second chamber at a higher position than that of the first communicating path inlet.

With this configuration, since the secondary bubble chamber is provided on the vertical upper side of the second chamber, it is possible to gather the bubbles on the vertical upper side of the second chamber, and to increase the retaining amount of the bubbles.

According to a second aspect of the invention, a liquid ejecting head is provided, which includes: a liquid introducing channel member provided with the above-mentioned bubble control unit; and a head body that ejects liquid supplied from the liquid introducing channel member from the nozzle by an operation of an actuator.

With this configuration, since the liquid ejecting head includes the liquid introducing channel member provided with the bubble control unit, and a head body having the nozzle, it is possible to easily control the behavior of the bubbles in the liquid channel by the flow rate of liquid. Further, at the time of a usual flow rate where the liquid is ejected from the nozzle, it is possible to prevent the liquid channel from being blocked by the bubbles. Furthermore, at the time of the cleaning operation where a flow rate is quickened by suction from the nozzle, or the like, it is possible to make the bubbles accumulated in the bubble chamber flow into the first chamber to thereby pass the bubbles through the filter and then easily discharge them to the downstream side.

In the above-mentioned configuration, it is preferable that the filter is vertically disposed with respect to the nozzle surface.

With this configuration, since the filter is vertically disposed with respect to the nozzle surface, it is possible to make smaller the area of the liquid ejecting head in a planar view, and to thereby downsize the liquid ejecting head.

According to a third aspect of the invention, a liquid ejecting apparatus is provided, which includes the above-mentioned liquid ejecting head, and a liquid reservoir that reserves the liquid to be supplied to the liquid supply portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the best embodiment for implementing the invention will be described with reference to the accompanying drawings and the like. In addition, although the embodiments described below are diversely confined as preferred specific examples of the invention, the scope of the invention is not limited to these embodiments unless stated that the invention is particularly confined in the description below. Further, in the embodiment, an ink jet type recording head (hereinafter, referred to as a "recording head") as an example of the liquid ejecting head will be described by way of example.

Figure 1:
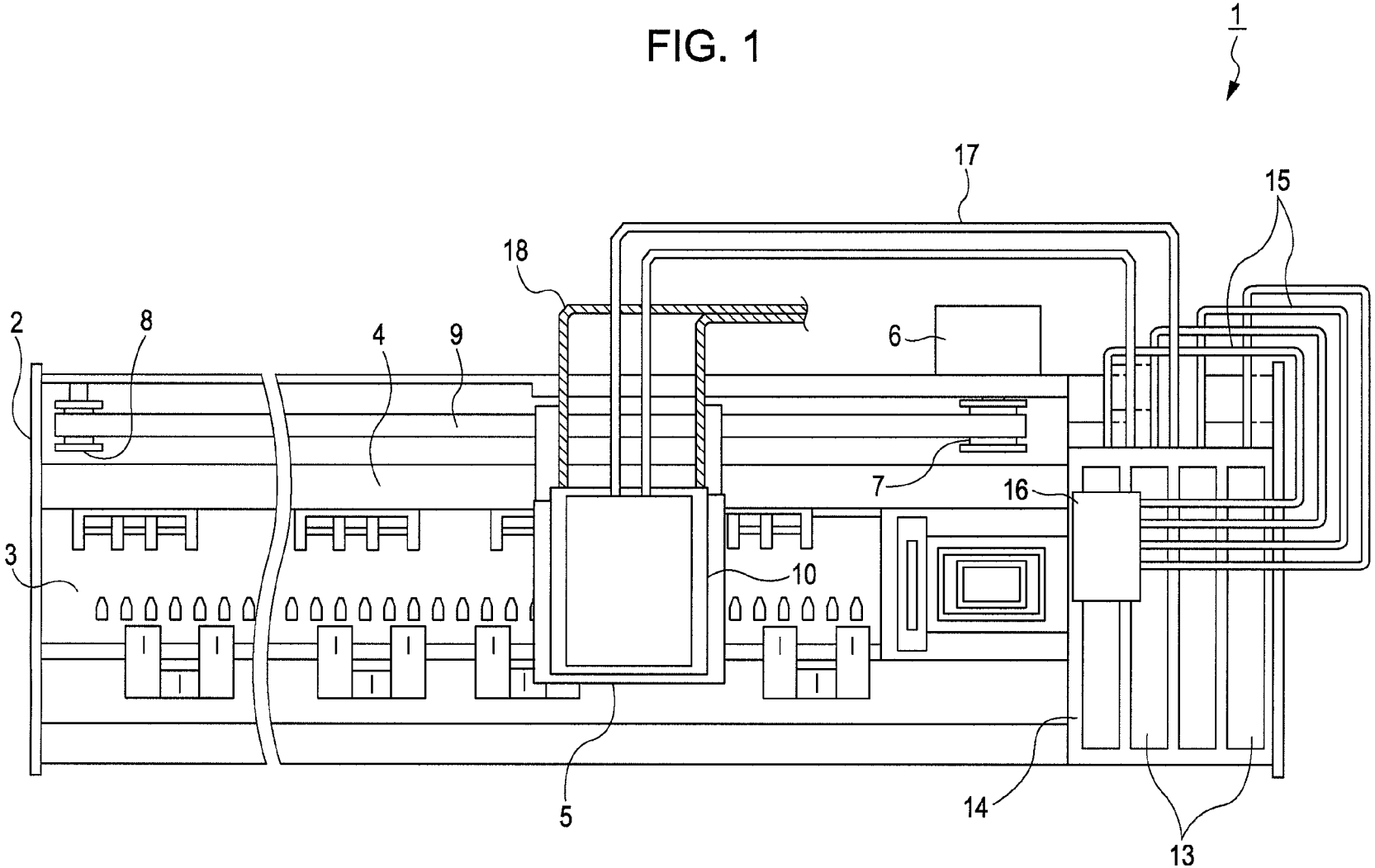
FIG. 1 is a plan view showing the configuration of a printer.

FIG. 1 is a plan view showing the configuration of an ink jet type recording apparatus on which a recording head 10 is mounted. First of all, the schematic configuration of the ink jet type recording apparatus on which the recording head is mounted (hereinafter, referred to as a printer) will be described with reference to FIG. 1. The illustrated printer 1 is an apparatus which discharges ink in the form of liquid to a surface of a recording medium (landed object: not shown) such as a recording paper to perform recording of an image or the like. This printer 1 includes a frame 2, and a platen 3 arranged within the frame 2, and is configured to transport the recording paper on the platen 3 by a paper feed roller rotated by the driving of a paper feed motor (none of which are shown). Further, in the frame 2, a guide rod 4 is constructed parallel to the platen 3. In this guide rod 4, a carriage 5 in which the recording head 10 is received is supported to be capable of sliding. This carriage 5 is connected to a timing belt 9 which is constructed between a driving pulley 7 rotated by the driving of a pulse motor 6, and an idling pulley 8 provided opposite to this driving pulley 7 in the frame 2. The carriage 5 is configured to reciprocate in the main scanning direction perpendicular to the paper feed direction along the guide rod 4 by driving the pulse motor 6.

A cartridge holder 14 on which ink cartridges 13 (a kind of liquid reservoir) are mounted to be removable is provided in one side of the frame 2. The ink cartridges 13 are connected to an air pump 16 via an air tube 15, and the air from this air pump 16 is supplied to the inside of each of the ink cartridges 13. Due to pressurization within the ink cartridges 13 by this air, ink is supplied (pneumatically transported) to the recording head 10 side through an ink supply tube 17.

The ink supply tube 17 is a hollow article that is manufactured with a synthetic resin such as silicon, and has flexibility. In the inside of this ink supply tube 17, ink channels corresponding to each ink cartridge 13 are formed. In addition, between the body side of the printer 1 and the side of the recording head 10, a flexible flat cable (FFC) 18 is arranged for transmitting the driving signal and the like from the control section of the body side of the printer 1 (not shown) to the side of the recording head 10.

Figure 2:
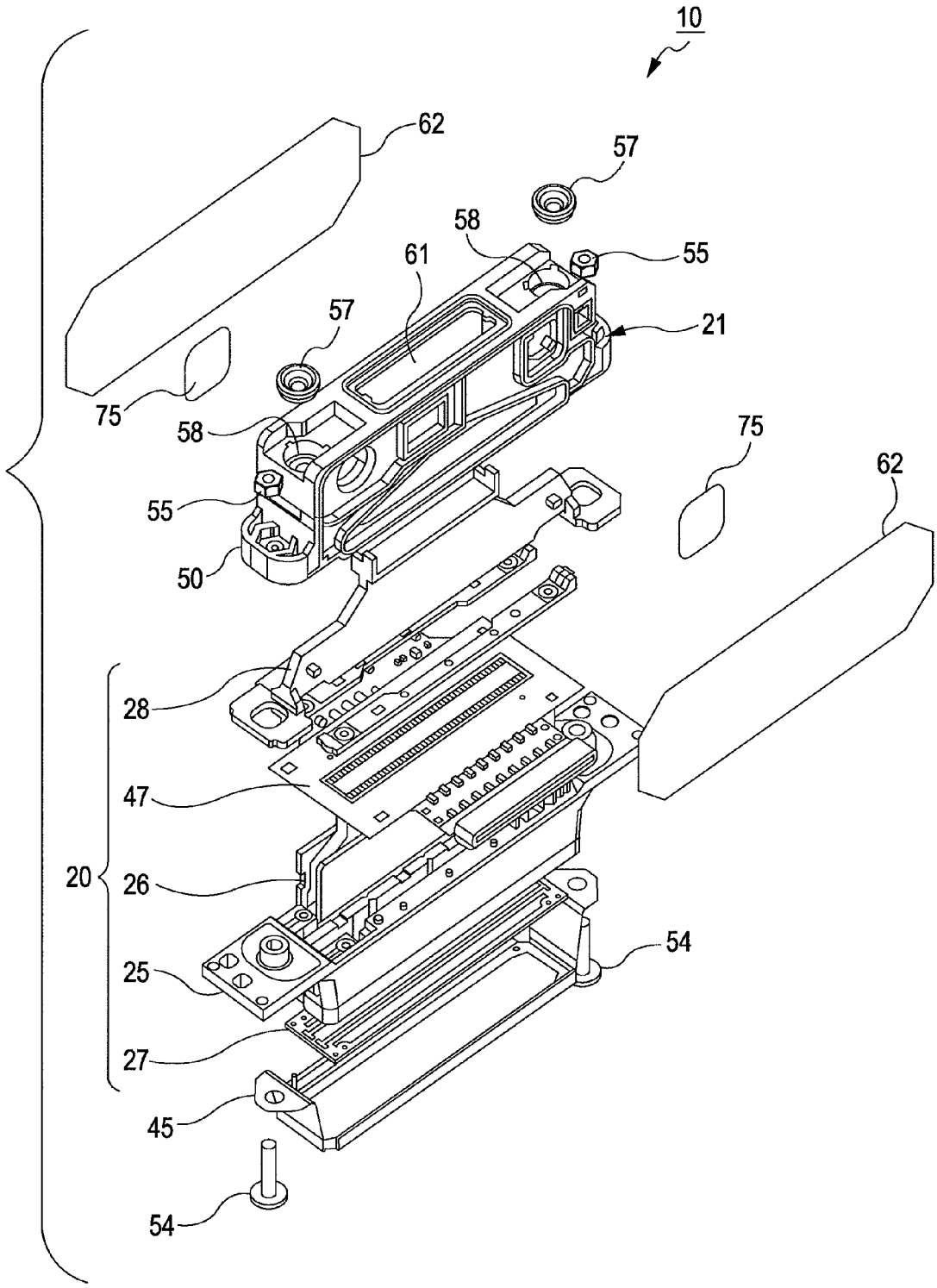
FIG. 2 is an exploded perspective view for describing the configuration of a recording head.
Figure 3:
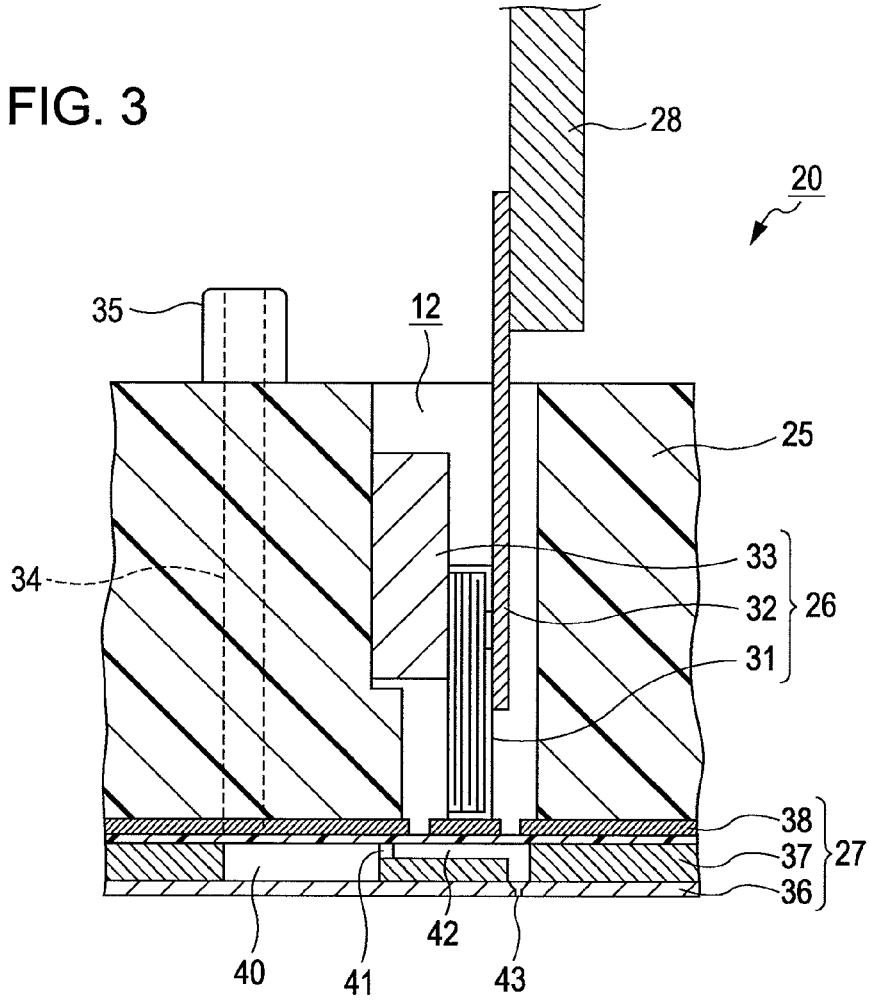
FIG. 3 is a cross-sectional view of a main part of a head body.

Next, the constitution of the recording head 10 will be described. Herein, FIG. 2 is a schematic perspective view of the recording head 10 attached to the carriage 5. FIG. 3 is a cross-sectional view of a main part of a head body 20 of the recording head 10. Exemplified recording head 10 has the head body 20 and one kind of a liquid introducing channel member 21 as major components. The head body 20 is constituted by a head case 25, an oscillator unit 26, a channel unit 27, and a driving substrate 28.

The head case 25 is a hollow box-shaped member. On the apical surface (lower surface) thereof, the channel unit 27 is fixed. The oscillator unit 26, which is a kind of actuator, is accommodated in an accommodating hollow section 12 formed in the inside of the case. On the upper surface side which is the opposite side of the apical surface, the driving substrate 28 and the liquid introducing channel member 21 are disposed. The upper surface of this head case 25 is a base end surface of this head body 20. In addition, in the inside of the head case 25, a case channel 34 is formed passing through the height direction thereof. This case channel 34 is a channel for supplying ink from the side of the liquid introducing channel member 21 to a common ink chamber 40. Two case channels 34 are provided for one common ink chamber 40. The recording head 10 in this embodiment has two common ink chambers 40 corresponding to 2 sets of the nozzle rows (nozzle group). A total of four case channels 34 are formed in the inside of the head case 25. On the upper surface of the head case 25, an inflow opening 35 is protrusively provided as the upstream end of each case channel 34. To this inflow opening 35, an ink introducing port 51 of the liquid introducing channel member 21 is connected.

The oscillator unit 26 is constituted by a plurality of piezoelectric vibrator 31, which is pectinately arranged in rows, a flexible cable 32 (a wiring member) for supplying the driving signal to this piezoelectric vibrator 31 from the driving substrate 28, and a clamped plate 33 for fixing the piezoelectric vibrator 31. The piezoelectric vibrator 31 is bonded to a partitioning flexible surface (a vibrating plate 38) that lays out a part of the pressure generation chamber 42. This piezoelectric vibrator 31 is stretched by the application of the driving signal to expand or contract the volume of the pressure generation chamber 42, thereby generating a pressure change in the ink in the pressure generation chamber 42. By controlling this pressure change, it is possible to eject the ink from a nozzle 43.

The channel unit 27 is manufactured by bonding in lamination and integrating a nozzle forming substrate 36 where the nozzle 43 is set up, a channel forming substrate 37 that forms an ink channel, and an surface vibrating plate 38 that seals the channel forming substrate 37. The channel unit 27 is a unit member that forms a series of ink channels (liquid channels) from the common ink chamber 40 to the nozzle 43 through the ink supply port 41 and the pressure generation chamber 42. The pressure generation chamber 42, which is branched from the common ink chamber 40, is formed for every nozzle 43, and is constituted to supply ink from the side of the liquid introducing channel member 21 via the case channel 34 and the common ink chamber 40. This channel unit 27 is bonded to the apical surface of the head case 25 in a position where the nozzle forming substrate 36 is directed to the lower side (the side of the platen 3 of the printer body). Therefore, this nozzle forming substrate 36 becomes a nozzle forming surface (a kind of a nozzle surface) in the head unit 20.

To the apical end of the head case 25 is further attached a head cover 45 to surround the periphery of the nozzle forming substrate 36 from the outside thereof. This head cover 45 is manufactured by, for example, a metallic laminate member. This head cover 45 has a function of protecting the channel unit 27 and the apical end of the head case 25, and also preventing charging of the nozzle forming substrate 36.

In the driving substrate 28, a flexible cable 32 is electrically connected by a solder fitting or the like to one end, and the FFC 18 from the side of the printer body is connected to the other end. The driving substrate 28 is constituted to receive the driving signal from the side of the control section through this FFC 18, and supply this driving signal to the side of the piezoelectric vibrator through the flexible cable 32. This driving substrate 28 retains its position by a substrate holding portion 61 provided to the liquid introducing channel member 21. This driving substrate 28 is disposed on the central portion of the upper surface of the head case 25 such that it stands up to the upper surface, and also the surfaces of the substrate are parallel to the direction of the nozzle rows. This driving substrate 20 is attached to the head case 25 via a sheet member 47 functioning as packing.

Figure 4:
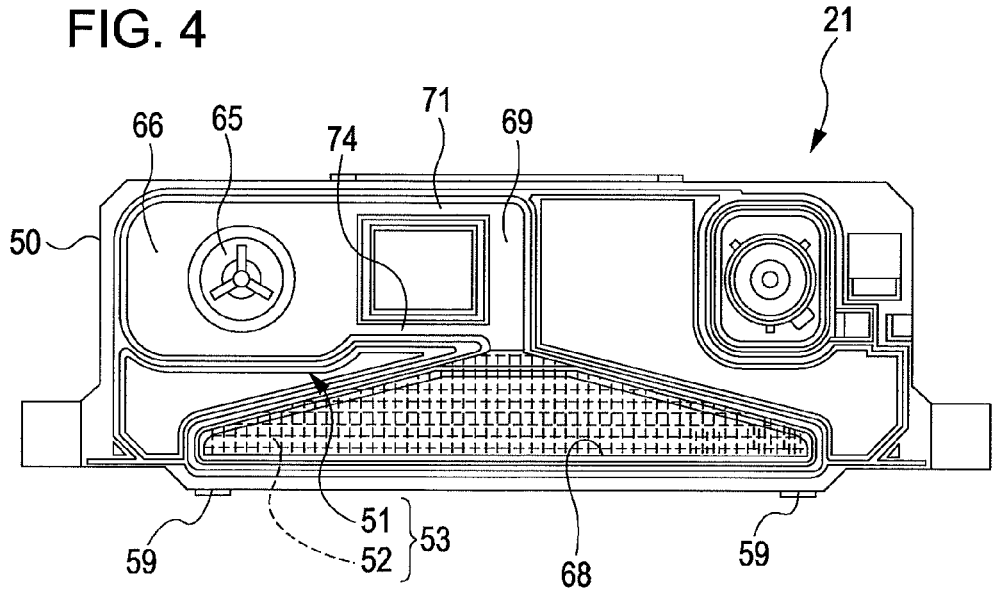
FIG. 4 is a plan view of a liquid introducing channel member.

Next, the constitution of the liquid introducing channel member 21 that introduces the ink in the ink cartridge 13 to the head body 20 will be described. FIG. 4 is an elevation view with the film 62 of the liquid introducing channel member 21 being removed. The liquid introducing channel member 21 is constituted by an introducing channel member body 50 made of a synthetic resin and the like and molded in a long box shape in the direction of the nozzle rows, and a bubble control unit 53 including an ink introducing port 51 (corresponding to a liquid channel in the invention) that supplies ink to the head body 20, and a filter 52 that is disposed in the course of the ink introducing port 51. This liquid introducing channel member 21 is disposed on the upper surface of the head case 25 (the base end surface of the head body 20) as overlapped in a position of being perpendicular to the nozzle surface. Furthermore, the liquid introducing channel member 21 is fixed by screwing the nut 55 to the screw 54 that is inserted into a through-hole formed on both ends in the longitudinal direction from the side of the head body 20.

In the introducing channel member body 50, an ink introducing hole 58 connected to the ink supply tube 17 via a packing 57 is formed on both sides of the longitudinal direction of the upper surface. A discharge hole 59 connected to the inflow opening 35 of the head body 20 is formed on both sides of the longitudinal direction of the lower surface. A series of channels including the ink introducing port 51 is formed between each of the ink introducing holes 58 and each of the discharge holes 59. The central portion of the introducing channel member body 50 is provided with the substrate holding portion 61 passing through it longitudinally, and constituted to retain the driving substrate 28 inserted into the substrate holding portion 61.

The ink introducing port 51 is a channel formed between the introducing channel member body 50 and the film 62 with welding the film 62 on both sides of the introducing channel member body 50. The ink introducing port 58 has a pressure chamber 66 provided with the seal valve 65 (a kind of the second chamber), a filter chamber 68 (a kind of the first chamber) where the filter 52 is disposed on the downstream side, and a bubble chamber 69 that extends from the filter chamber 68 to the vertical upper side. The ink introducing port 58 includes the first communicating path 71 that communicates between the pressure chamber 66 and the filter chamber 68, and the second communicating path 74 which makes ink within the pressure chamber 66 to flow into the filter chamber 68 from a second communicating path inlet provided separately from the first communicating path inlet in the vertical lower side (that is, low position) from the first communicating path inlet to which this first communicating path 71 is connected to the upper end of one side of the pressure chamber 66.

The pressure chamber 66 is a thin chamber that is disposed in the upstream side from the filter chamber 68, and formed in the unilateral half of the vertical upper side of the lateral surface of the introducing channel member body 50. This pressure chamber 66 includes the seal valve 65 in the center of the surface opposite to the film 62, and communicates with the upstream channel (not shown) that has a secondary filter 75 and ink introducing holes 58 in the upstream via this seal valve 65. This seal valve 65 is constituted such that it changes from the closed state to the open state when the ink is discharged from the nozzle 43 of the side of the head body 20 to relatively lower the pressure in the pressure chamber 66. This seal valve 65 adjusts the pressure of the ink from the side of the ink cartridge 13 (upstream).

The first communicating path 71 includes a horizontal portion 76 that extends horizontally from a first communicating path inlet 71*a* toward the center of the introducing channel member body 50, and the bubble chamber 69 that extends between the horizontal portion 76 and the filter chamber 68 in the vertical direction. The bubble chamber 69 is formed in a wider range than that of the horizontal portion 76, and is constituted to gather (trap) bubbles dissolved in the ink (shown as the symbol A in FIG. 5*a*). To the vertical lower side (that is, the downstream side) of this bubble chamber 69 is connected the second communicating path outlet 74*b* of the second communicating path 74, where the first communicating path 71 and the second communicating path 74 join together to communicate with the filter chamber 68. In addition, the second communicating path 74 is formed at the substantially same width as that of the first communicating path 71. The second communicating path 74 extends horizontally below the first communicating path 71 from the second communicating path inlet 74*a* toward the center of the introducing channel member body 50, and is disposed to be parallel to the first communicating path 71.

The filter chamber 68 is a thin chamber that is disposed in the downstream side from the pressure chamber 66, and formed in the central vertical lower side of the lateral surface of the introducing channel member body 50. This filter chamber 68 is manufactured in a tapered shape that is widened gradually from the upstream side of the vertical upper side toward the downstream side of the vertical lower side. The highest apex is provided with the first communicating path outlet 71*b* of the first communicating path 71. The filter chamber 68 is provided with the filter 52 as attached that is vertically disposed with respect to the nozzle forming substrate 36 on the surface opposite to the film 62. The filter chamber 68 communicates via this filter 52 with the downstream channel (not shown) that has the discharge hole 59 in the downstream side.

As described above, the ink introducing port 51 is constituted to supply ink, which is introduced to the inside of the introducing channel member body 50 from the ink introducing hole 58, to the inside of the pressure chamber 66 from the sealing valve 65 in the open state, to make the ink to flow from the pressure chamber 66 through the first communicating path 71 and the second communicating path 74 into the filter chamber 68, and supply it to the discharge hole 59 via the filter 52.

Figure 5A:
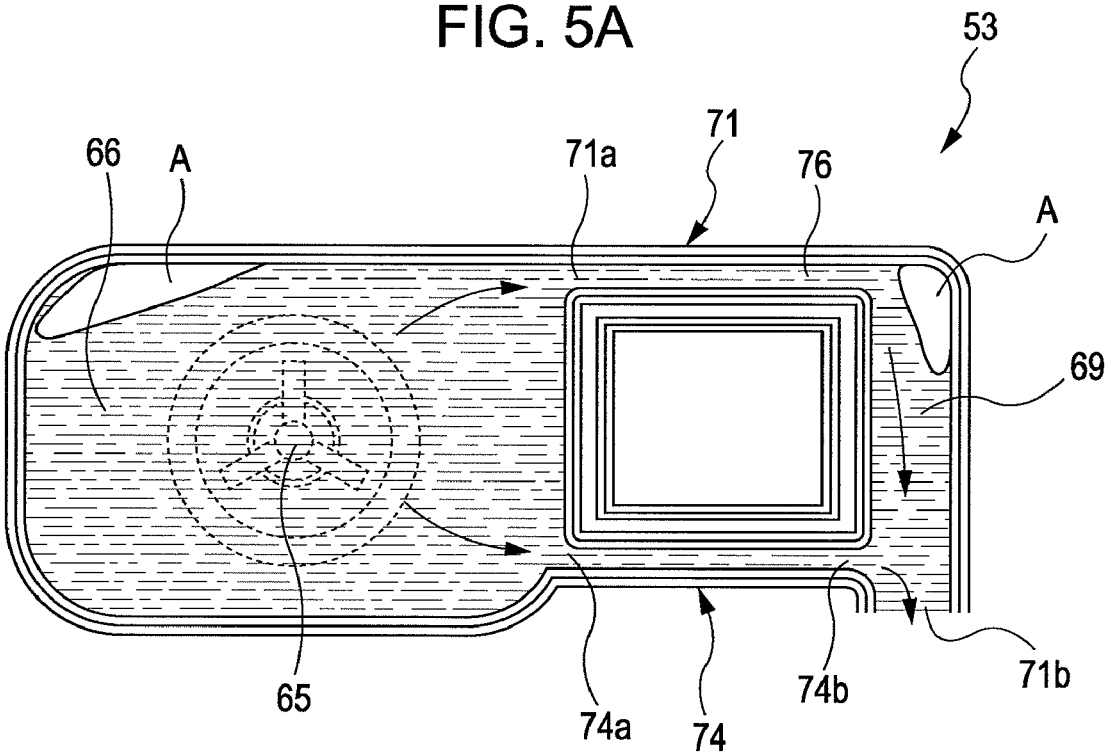
FIGS. 5*a*-5*b* is an explanatory diagram for describing the flow of the ink in the bubble unit.

Next, a case will be described where the bubbles A are mixed in the inside of the bubble control unit 53. FIG. 5*a* is an explanatory diagram for describing the flow of the ink in the bubble control unit 53. First of all, the bubbles A, which have intruded from the side of the sealing valve 65 to the inside of the pressure chamber 66, are accumulated on the upper surface of the side of the vertical upper side of the pressure chamber 66. On the other hand, the bubbles A in the filter chamber 68 float up toward the vertical upper side from the filter chamber 68 to be accumulated in the bubble chamber 69. If the ink is makeed to flow to the ink introducing port 51 at the usual flow rate in this state (a state where the ink droplet is squirted from the nozzle to print), the bubbles A, which have been pushed by the ink that flows the first communicating path 71 and the second communicating path 74, move at the angle of the vertical upper side of the bubble chamber 69 and the pressure chamber 66 (FIG. 5(*a*)). If the bubbles A grow gradually with the passing of the time during use, the grown bubbles A are accumulated in the vertical upper side of the bubble chamber 69 and the pressure chamber 66, and the upstream side of the first communicating path 71 is filled with the bubbles A (FIG. 5(*b*)). If the ink is made to flow to the ink introducing port 51 at the usual flow rate in this state, it is possible to make the ink to flow to the second communicating path 74 from the pressure chamber 66, and flow into the filter chamber 68 through the second communicating path outlet 74*b* of the downstream side of the bubble chamber 69. At this usual flow rate, the bubbles exist in the upstream side of the first communicating path 71 and in the bubble chamber 69, and thus no ink passes through this first communicating path 71. Therefore, it is possible to prevent the accumulated bubbles from moving to the side of the filter chamber 68.

If a cleaning operation is performed that accelerates the flow rate of ink of the ink introducing port 51 in the state where the bubbles are accumulated in the bubble chamber 69, the bubbles A are carried in a large volume into the filter chamber 68, and cover a wide area of the filter 52. If the filter 52 is in a state of being covered with the bubbles, the pressure difference between the upstream side and the downstream side of the filter 52 increases. Due to this large pressure difference, the bubbles are discharged at a stroke from the filter 52 to the downstream side. Even though the bubbles are discharged at a stroke from the filter chamber 68 by the cleaning, in practice small bubbles remain in the filter chamber 68. However, the small bubbles float up in the inside of the filter chamber 68 due to buoyancy if the cleaning suction stops, move along the sloping upper margin, and at last float up the first communicating path 71 extending upward from the apex to be reserved in the bubble chamber 69. Therefore, drawbacks do not occur such that the bubbles remaining without being discharged by the cleaning are carried to the side of the case channel 34 to clog up the nozzle.

Figure 5B:
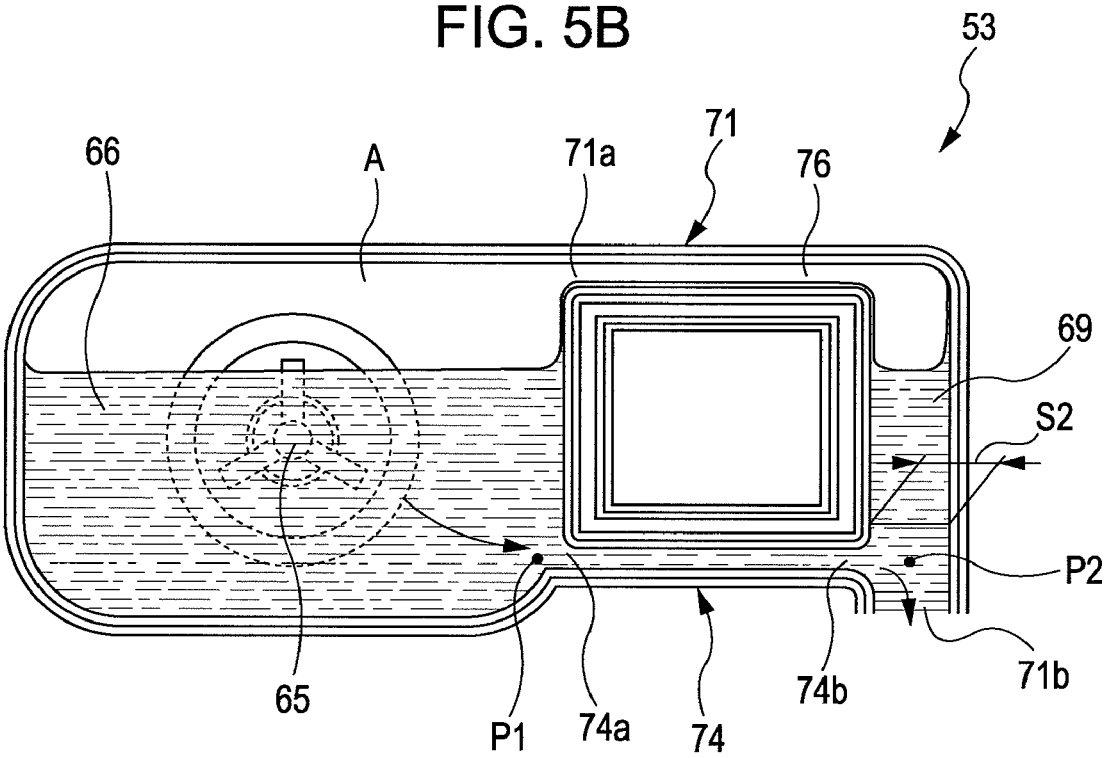

The control of the bubbles in the ink introducing port 51 by the bubble control unit 53 will be described using FIG. 5(*b*). First of all, P1 is the pressure of the pressure chamber 66 in a state where a large amount of the bubbles A is accumulated in the first communicating path 71. P2 is the pressure of the bubble chamber 69, S2 is the bubble sectional area in the side of the bubble chamber 69, and k is the coefficient of the resistance of the second communicating path 74. When the flow of the flow volume Q is generated in the second communicating path 74, the power affecting the bubbles A is the buoyancy Ff and the suction power according to $F\Delta P$. Herein, if the influences of the buoyancy and the suction power of the side of the pressure chamber 66 are assumed to be imperceptible, it becomes that $F\Delta P = P2 \times S2$. If the coefficient of resistance k of the second communicating path 74 is setup such that the bubbles A float up to stagnate when $Ff > F\Delta P$, and on the other hand, the bubbles A are made to flow downstream when Ff<FΔP, it is possible to control the bubbles A of the bubble control unit 53 such that the bubbles are put to stagnate in the bubble chamber 69 in the usual ejection state such as the print being processed, and the bubbles in the bubble chamber 69 move to the filter chamber 68 with a given flow rate in the cleaning time, etc. to largely cover the filter 67, to thereby pass the bubbles at a stroke to discharge them.

As described above, the bubble control unit 53 of the embodiment can accumulate the bubbles A grown in the inside of the ink introducing port 51 within the bubble chamber 69 and the pressure chamber 66 to retain the bubbles, and can suppress the consumption of ink by reducing the number of executions of the cleaning operation. In addition, since the pressure chamber 66 and the bubble chamber 69 communicate with each other by the first communicating path 71 and the second communicating path 74, it is possible to pass ink in the pressure chamber 66 through the second communicating path 74 to supply the ink to the filter chamber 68 even though the first communicating path 71 is clogged up with the bubbles A and the like. Herewith, it is possible to prevent poor discharge such as dead pixels caused by the bubbles A from occurring.

Figure 6:
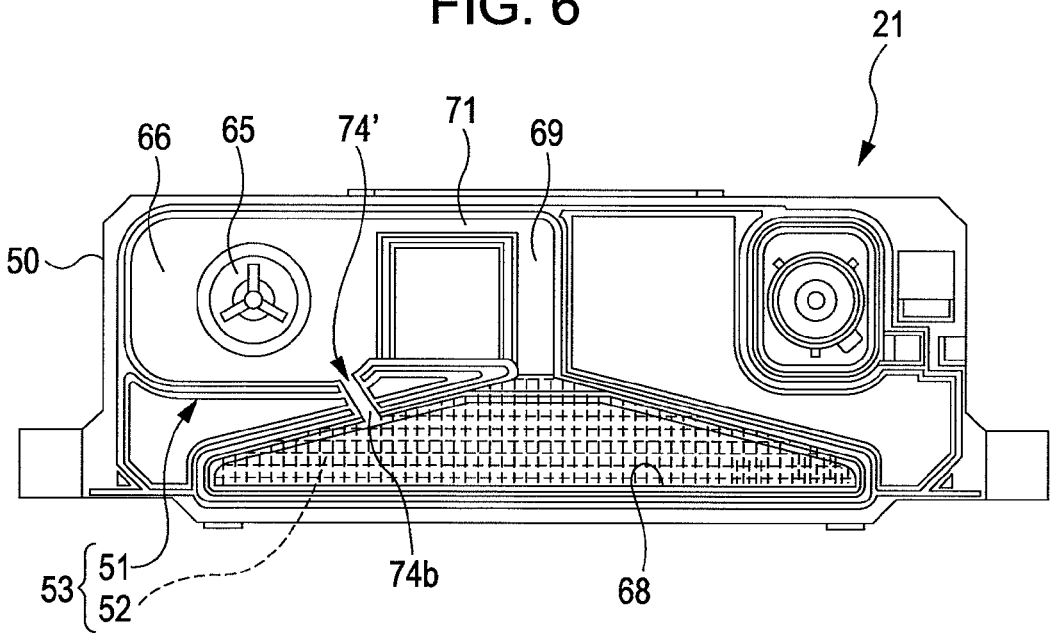
FIG. 6 is a plan view of a modified example of the liquid introducing channel member.

The invention is not limited to the above-described embodiments, but all sorts of variations are possible based on the description of the claims of the invention. FIG. 6 is a plan view of a modified example of the liquid introducing channel member.

In the above-described embodiment, an example has been shown where the second communicating path outlet 74*b* of the second communicating path 74 is connected to the downstream end of the bubble chamber 69 to join it together to the first communicating path 71 and then to communicate with the filter chamber 68. However, the invention is not limited thereto. The liquid introducing channel member of the invention may include the second communicating path 74 that is connected to the pressure chamber 66 separately from the first communicating path inlet 71*a* in a lower position than that of the first communicating path inlet 71*a*. For example, the second communicating path inlet 74*a* may be provided in the vertical lower side from the first communicating path inlet 71*a* of the pressure chamber 66 and in the lowest position of the pressure chamber 66. Also, the second communicating path outlet 74*b* of the second communicating path 74' extending therefrom may be provided and connected in the sloping upper margin of the filter chamber 68. That is, the second communicating path 74' may communicate with the pressure chamber 66 and the filter chamber 68 separately independent from the first communicating path 71 from the inlet to the outlet. By this, it is possible to reliably prevent clogging up of the second communicating path outlet 74*b* by the bubbles A that rise from the filter chamber 68 toward the vertical upper side.

Figure 7:
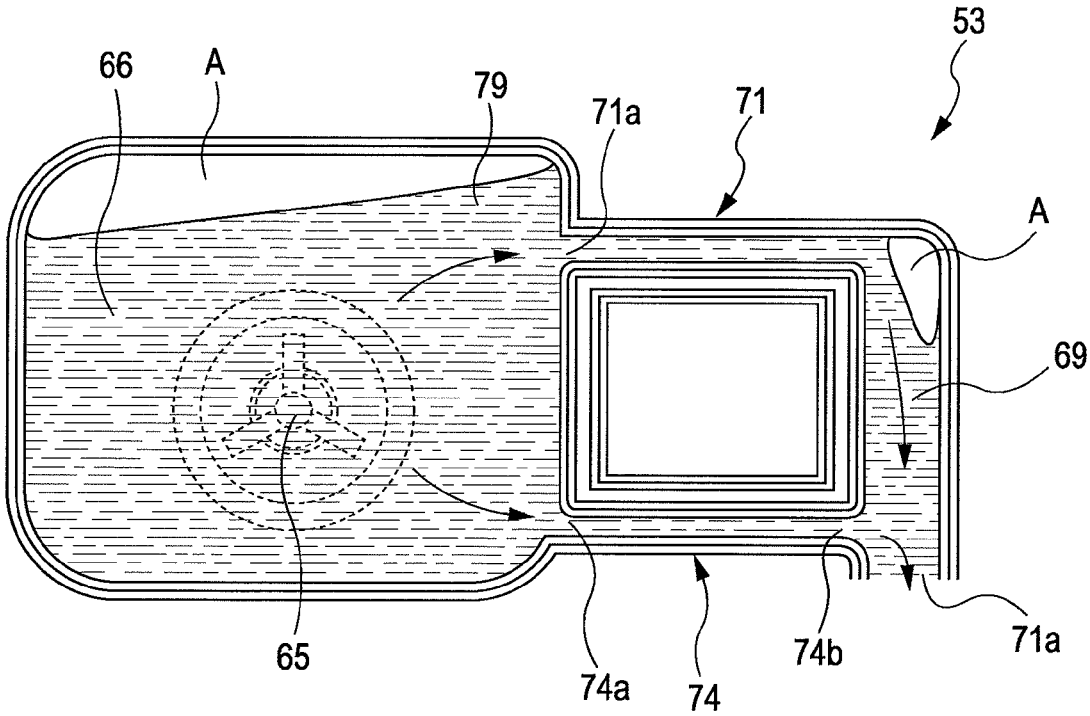
FIG. 7 is an explanatory diagram for describing a modified example of the bubble unit.

In addition, FIG. 7 is an explanatory diagram for describing a modified example of the bubble unit. In this embodiment, the upper surface of the vertical upper side of the pressure chamber 66 is formed on the vertical upper side (high position) from the first communicating path inlet 71*a*, and a secondary bubble chamber 79 is provided in the upper portion of the pressure chamber 66. By this, if the secondary bubble chamber 79 is formed in the upper portion of the pressure chamber 66, the bubbles A can be easily accumulated on the upstream side, and also the amount retained of the bubbles A can be increased.

In the above, the printer 1, which is a kind of liquid ejecting apparatus, has been described as an example. However, it is possible to apply the invention to other liquid ejecting apparatus. For example, it is possible to apply the invention to a display manufacturing apparatus that manufactures a color filter such as a liquid crystal display, an electrode manufacturing apparatus that forms an electrode such as an organic EL (Electro Luminescence) display and an FED (surface-emitting display), a chip manufacturing apparatus that manufactures a biochip (biotip) and the like.

What is claimed is:

1. A bubble control unit for a liquid ejecting head which ejects liquid from a nozzle, the unit comprising a liquid channel through which the liquid is supplied to the nozzle, wherein the liquid channel includes:

a first chamber;

a second chamber disposed on the upstream side from the first chamber;

a first communicating path which has a bubble chamber extending upward from the first chamber, and makes the liquid within the second chamber to flow into the first chamber from a first communicating path inlet of the second chamber;

a second communicating path which is provided with a second communicating path inlet below the first communicating path inlet, separately from the first communicating path inlet, and makes the liquid within the second chamber to flow into the first chamber from the second communicating path inlet;

a sealing member to seal the liquid channel from both sides of a channel member body; and a seal valve configured to adjust the pressure of the liquid on the upstream side and disposed on a side of the second chamber.

2. The bubble control unit according to claim 1, wherein a filter is disposed in the course of the liquid channel, and wherein the filter is provided on the downstream side of the first chamber.

3. The bubble control unit according to claim 1, wherein in the downstream side of the bubble chamber, a second communicating path outlet communicates with the first communicating path.

4. The bubble control unit according to claim 1, wherein the second communicating path outlet of the second communicating path connected to the first chamber is provided below a first communicating path outlet connected to the first chamber.

5. The bubble control unit according to claim 1, wherein a secondary bubble chamber is provided on the upper portion of the second chamber by forming the upper surface of the second chamber at a higher position than that of the first communicating path inlet.

6. A liquid ejecting head, comprising:

a liquid introducing channel member provided with the bubble control unit according to claim 1; and a head body that ejects liquid supplied from the liquid introducing channel member from the nozzle by an operation of an actuator.

7. The liquid ejecting head according to claim 6, wherein the filter is vertically disposed with respect to the nozzle surface.

8. A liquid ejecting apparatus, comprising:

the liquid ejecting head according to claim 6; and a liquid reservoir that reserves the liquid to be supplied to the liquid channel of the bubble control unit.

* * * * *